United States Patent [19]

Goldberg

[11] Patent Number: 4,801,217

[45] Date of Patent: Jan. 31, 1989

[54] CONSTRUCTION MAT FORMED FROM DISCARDED TIRE BEADS AND METHOD FOR ITS USE

[76] Inventor: Jerry Goldberg, 462 Arbor Cir., Youngstown, Ohio 44505

[21] Appl. No.: 934,347

[22] Filed: Nov. 24, 1986

[51] Int. Cl.[4] ..... E01C 21/00

[52] U.S. Cl. ..... 404/75; 404/28; 404/70; 404/35; 405/258

[58] Field of Search ..... 404/17, 27, 28, 31, 404/35, 36, 70, 75, 71; 405/15, 16, 17, 30, 258

[56] References Cited

U.S. PATENT DOCUMENTS

| | | | |
|---|---|---|---|
| 612,821 | 10/1898 | Butcher | 404/70 |
| 3,850,537 | 11/1974 | Bynum, Jr. | 404/17 |
| 4,142,821 | 3/1979 | Doring | 405/16 X |
| 4,188,153 | 2/1980 | Taylor | 405/30 X |

FOREIGN PATENT DOCUMENTS

| | | | |
|---|---|---|---|
| 9924 | 1/1980 | Japan | 405/16 |

*Primary Examiner*—Jerome W. Massie
*Assistant Examiner*—Matthew Smith
*Attorney, Agent, or Firm*—Clifford A. Poff; Thomas H. Murray

[57] ABSTRACT

A mat construction usable in the construction, mining and the like industries wherein tire beads from used tires are tied together into an array with the use of strips of used tire casing. The mat can be used as an underlayment for roadways built over unstable ground surfaces, or a number of the mats can be superimposed one upon the other to form a blasting mat. The mats can be formed by inexpensive laborers at the construction site, for example.

4 Claims, 1 Drawing Sheet

CONSTRUCTION MAT FORMED FROM DISCARDED TIRE BEADS AND METHOD FOR ITS USE

BACKGROUND OF THE INVENTION

In the construction, farming and logging industries, for example, it is sometimes necessary to build a temporary road over an unstable ground surface, such as that found in swamps or formed of muskeg. Methods such as that shown in U.S. Pat. No. 3,880,538 have been devised for building roads over unstable ground surfaces wherein a mat of rigid polyurethane is laid over the unstable ground surface and then covered with a particulate material or earth fill, the mat acting to distribute the weight of a vehicle traveling over the particulate material and prevent it from sinking into the unstable ground beneath. This method, however, is disadvantageous in that it is expensive in requiring the use of relatively costly plastic materials.

Mats are also used in the construction and mining industries as blasting mats. Here, again, the mats are relatively expensive. In certain cases, for example, the mats are formed from steel cables woven together. A mat of this type is relatively heavy and a crane is required at the construction site to put it in place prior to the blasting operation. Furthermore, inasmuch as the mat is formed from steel, there is always the possibility of a short between the detonation wires.

SUMMARY OF THE INVENTION

In accordance with the present invention, a mat construction is provided for applications of the type described above which is exceedingly low in cost, inasmuch as it uses only discarded and otherwise useless materials.

Specifically, the invention contemplates the use of tire beads, a useless by-product of tire recycling, which are tied together with strips of used tire casings to form a mat which can be used as a blasting mat and as a substrate for roads built on unstable ground surfaces.

In the case where the mat is used as a substrate for roads, it is placed over the unstable ground surface and earth fill or particulate matter is thereafter placed over the top of the mat which acts to reduce the penetration of road bed into the substrate as a result of vehicle loads by transferring vertical forces into horizontal pull on the tire beads. In effect, this acts as a force virtually pulling the beads through an earthen mass. The loads which tend to push the road bed down also act to increase the resistance to horizontal movement of the tire beads until penetration of the road bed stops.

In the case where the mat is used as a blasting mat, preferably several rectangular arrays of tire beads are superimposed one above the other such that arcuate portions of one array will extend over and cover the openings in lower or higher beads to prevent the escape of rocks or other debris when the blast occurs.

A distinct advantage of the present invention is that the tire beads, which are relatively light-weight, can simply be transported to the site where they are to be used and then tied together manually, thereby obviating the need for a crane or the like a is required with heavy mats previously used.

The above and other objects and features of the invention will become apparent from the following detailed description taken in connection with the accompanying drawings which form a part of this specification and which:

Figure 1:
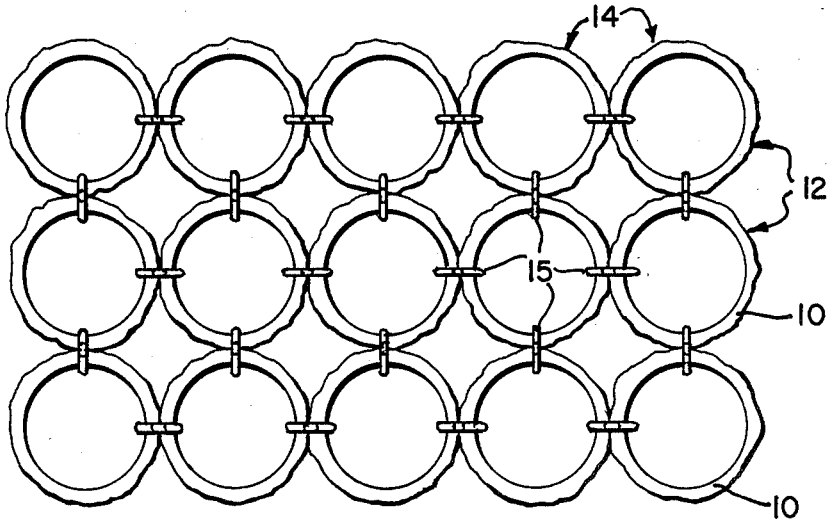
FIG. 1 is a top of plan view of a mat constructed from discarded tire beads in accordance with the invention.

With reference now to the drawings, and particularly to FIG. 1, a top view of the mat of the present invention is shown. It is formed from tire beads which are otherwise discarded from a tire recycling process. In this regard, the tire casing is initially cut from the tire bead, which contains an annular steel ring, prior to the casings being cut into strips or the like. Ordinarily, the beads must be discarded.

In accordance with the present invention, however, tire beads, identified by the reference numeral 10 in FIG. 1 are formed in a two-dimensional array arranged in linear rows 12 extending from left to right in FIG. 1 and linear columns 14 which are at right angles to each other. Fastening means secure the tire beads together in the array shown in FIG. 1 at their peripherally facing surfaces. The fastening means may, for example, comprise tire casing strips 15 which encircle the tire beads at their peripherally facing surfaces, each strip having its ends tied together in a square knot, for example, to form a loop. In the case where the mat is used as a flexible underlayment for succeeding layers of road base courses, the tightness of the casing strips looped around facing edges of the tire beads is not particularly critical. However, in the case where the mat is used in blasting operations, the fastening means should be as tight as possible.

Figure 2:
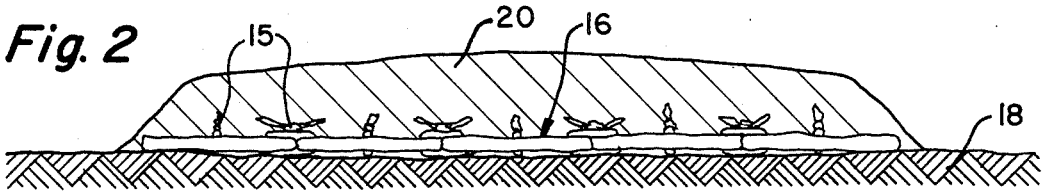
FIG. 2 is an elevational view of a mat as applied to an unstable ground surface for the purpose of distributing a load more or less evenly over the ground surface.

FIG. 2 illustrates a typical application of the present invention as an underlayment for road base courses. The mat, generally indicated by the reference numeral 16, is initially formed at the site by low-cost laborers which place the tire beads 10 in position and then tie them together by means of the tire strips 15. The unstable ground surface, which may be swampy ground or muskeg as explained above, is identified by the reference numeral 18 in FIG. 2. Earth fill 20 or other suitable road base course material is then poured over the mat 16. In this way, when a vehicle, for example, travels over the fill 20, its weight will be distributed over the entire area of the mat and will effectively prevent wheels of the vehicle from sinking into the unstable ground surface. The fill 20 also creates a resistance to lateral movement. It will be understood that the width of the mat is a function of the width of the desired roadway and its length is a function of the length of the roadway. Concentrated loads at the center of the fill area place the beads in tension as well as compression.

Figure 3:
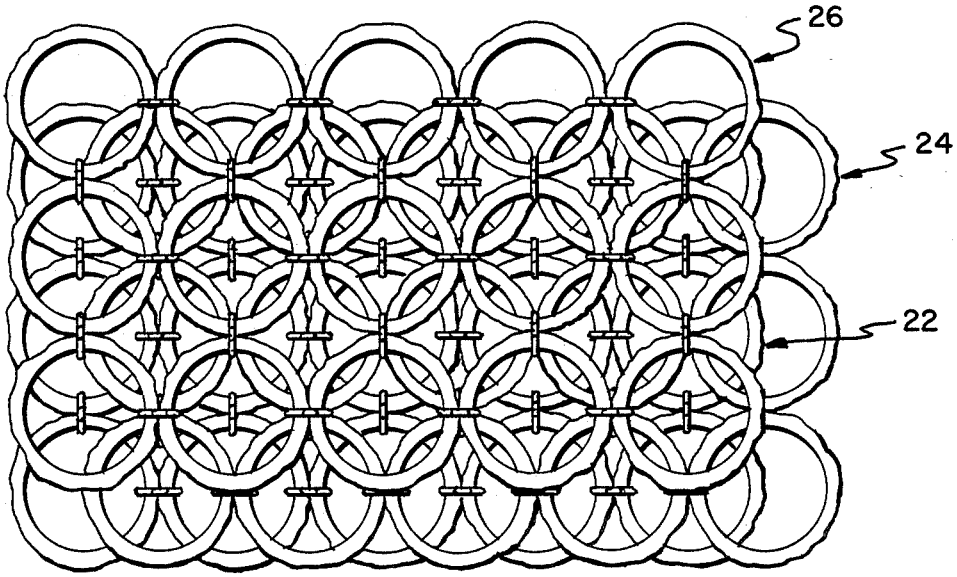
FIG. 3 is a plan view of a typical blasting mat configuration utilizing the principles of the invention.

FIG. 3 illustrates an application of the invention to blasting operations wherein three mats 22, 24 and 26 are placed one above the other such that the arcuate portions of one mat overlap the central opening of the tire beads above and below. The mat shown in FIG. 3 can be formed by simply carrying the light-weight tire beads to the blasting site and then tying them together and superimposing one mat above the other without the necessity for using a crane.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. A method for laying a road surface over unstable ground surfaces comprising the steps of placing the mat of a two-dimensional array of circular tire beads arranged in linear rows and columns extending at right angles to each other, and fastening means securing said tire beads together into a mat only at their peripherally facing surfaces over the unstable ground surface such that said beads are in proxial relation for ensuring the beads are placed in tension as well as compression under roadway loads, and thereafter pouring at least one layer of road base course material over the mat, whereby the weight of a vehicle traveling over the road surface will be distributed over the entire area of the mat.

2. A method for forming a blasting mat from the mat construction of a two dimensional array of circuit tire beads arranged in linear rows and columns extending at right angles to each other, and fastening means securing said tire beads together into a mat only at their peripherally facing surfaces such that a force of a blast is transferred from bead to bead by said fastening means, comprising forming a number of said two-dimensional arrays of tire beads and superimposing one array upon another over a blasting area such that the centers of the tire beads of the respective layers are not aligned with each other.

3. The method according to claim 2 wherein said fastening means includes strips for tieing together said beads.

4. The method according to claim 2 wherein said fastening means including tire casing strips.

* * * * *